US010485279B2

(12) United States Patent
Warren

(10) Patent No.: US 10,485,279 B2
(45) Date of Patent: Nov. 26, 2019

(54) WEATHER EXPOSURE REDUCTION APPARATUS

(71) Applicant: David Allen Warren, Ephrata, WA (US)

(72) Inventor: David Allen Warren, Ephrata, WA (US)

( * ) Notice: Subject to any disclaimer, the term of this patent is extended or adjusted under 35 U.S.C. 154(b) by 355 days.

(21) Appl. No.: 15/422,401

(22) Filed: Feb. 1, 2017

(65) Prior Publication Data

US 2017/0231292 A1 Aug. 17, 2017

Related U.S. Application Data

(63) Continuation-in-part of application No. 14/998,753, filed on Feb. 12, 2016, now abandoned.

(51) Int. Cl.
*A41D 17/02* (2006.01)
*A41D 31/102* (2019.01)

(52) U.S. Cl.
CPC ..... *A41D 17/02* (2013.01); *A41D 31/102* (2019.02); *A41D 2400/10* (2013.01); *A41D 2600/102* (2013.01)

(58) Field of Classification Search
CPC .. A41D 1/067; A41D 1/08; A41D 1/22; A61F 13/14; A41B 9/04; A41B 11/14
USPC ..... 2/466, 69, 406–408, 70–72, 103, 106
See application file for complete search history.

(56) References Cited

U.S. PATENT DOCUMENTS

| | | | | |
|---|---|---|---|---|
| 3,880,160 | A * | 4/1975 | Hall | A63B 71/12 450/111 |
| 4,959,594 | A * | 9/1990 | Ruby | H03K 4/696 315/397 |
| 5,295,267 | A | 3/1994 | Galindo | |
| 6,338,164 | B1 | 1/2002 | Howard | |
| 7,418,743 | B2 * | 9/2008 | Tsujimoto | A63B 71/1216 2/466 |
| 2003/0226197 | A1 | 12/2003 | Cramer | |
| 2005/0150030 | A1 | 7/2005 | Davis | |
| 2010/0229273 | A1 * | 9/2010 | Crye | F41H 1/02 2/2.5 |
| 2015/0167211 | A1 * | 6/2015 | Hiatt | D04B 3/02 66/1 A |

* cited by examiner

*Primary Examiner* — Timothy K Trieu
(74) *Attorney, Agent, or Firm* — Lee & Hayes, P.C.

(57) ABSTRACT

An article of apparel includes a covering having a first portion, a second portion, and a bulge that extends across a union of the first and second portions. The covering is sized to substantially fill a frontal void of a pair of chaps. The article of apparel further includes an attachment structure with which the article of apparel is attachable to a secondary article of apparel.

19 Claims, 4 Drawing Sheets

Back

WEATHER EXPOSURE REDUCTION APPARATUS

CROSS REFERENCE TO RELATED APPLICATION

This application is a continuation-in-part of U.S. patent application Ser. No. 14/998,753 filed Feb. 12, 2016, the entire disclosure and contents of which are hereby incorporated by reference herein.

BACKGROUND

Motorcycles are a popular mode of transportation worldwide in a variety of different environments. Furthermore, despite the challenges with varying temperatures and climates, motorcyclists often ride their motorcycles year-round and even during periods of inclement weather. During colder seasons and/or bitter weather, various clothing options are available to protect motorcyclists from the elements. However, a clothing option selected for particular weather or conditions that exist during a portion of a rider's travel may not be desirable or suitable for a different portion of the travel. For example, a motorcyclist who rides early in the day may desire to wear warm clothing during the early morning when the atmosphere is colder, but subsequently, as the day warms up, the rider may not desire such apparel. Accordingly, changing conditions or weather may exist throughout the course of a motorcyclist's travel. Given the great degree of variable conditions, a motorcyclist may desire a clothing option that is readily adaptable during periods of changing weather.

Motorcycle chaps are commonly worn to protect motorcyclists from the wind, inclement weather, and changing conditions while riding. Chaps also serve to protect the motorcyclist during the occurrence of a fall or crash. Due to the body motions that a rider generally must perform when using a motorcycle (e.g., mounting and dismounting the motorcycle), and the position of the rider's body straddling the engine when seated, motorcycle chaps frequently are made to cover only the legs of the rider and do not directly connect at the waist to permit mobility and comfort. Inasmuch as there is no material spanning between the leg covering "chaps," motorcycle chaps generally use a belt-type system to maintain the top of both sides of the chaps in position at or near the top of the respective leg. That is, the chaps are independently interconnected by a belt that wraps around the rider's waist, while leaving the rider's rear and groin uncovered. While there are certain advantages to the void of material between the chaps on the front and rear of the rider, such as comfort and mobility as mentioned above, the absence of material also leaves the rider's groin area relatively exposed. Although the exposure created by a lack of material between the chaps may be of little hindrance in some situations, in general, the void of material allows environmental elements to impact the motorcyclist more directly than if the material was continuous between the chaps. For example, during a rider's travels, the void of material exposes the rider's groin area to rocks, precipitation (rain, snow, etc.), and other debris that may fall or be thrown/kicked up by other forces. Therefore, the potential for injury, discomfort, temperature fluctuation, and/or pain due to external forces is significant.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features. Furthermore, the drawings may be considered as providing an approximate depiction of the relative sizes of the individual components within individual figures. However, the drawings are not to scale, and the relative sizes of the individual components, both within individual figures and between the different figures, may vary from what is depicted. In particular, some of the figures may depict components as a certain size or shape, while other figures may depict components on a larger scale or differently shaped for the sake of clarity.

DETAILED DESCRIPTION

Overview

This disclosure is directed to an article of apparel for use to reduce the impact that environmental elements may have on a user. While not limited to any particular group of users, the article of apparel described herein may be well-suited for use by motorcyclists wearing chaps, other chap wearing users, etc. Traditional clothing solutions for inclement weather are often cumbersome and require a user to take excessive time to put on or remove the articles. An alternative solution is desired by users to protect themselves from cold, wind, and wet weather, while not sacrificing mobility, control, and safety. As described previously, traditional chaps exhibit a void of material in the front and rear between two leg coverings. The article of apparel described herein may fit within the void in the front of chaps, while not sacrificing the mobility and comfort of traditional chaps. The article of apparel is described with respect to the figures as follows.

Figure 1:
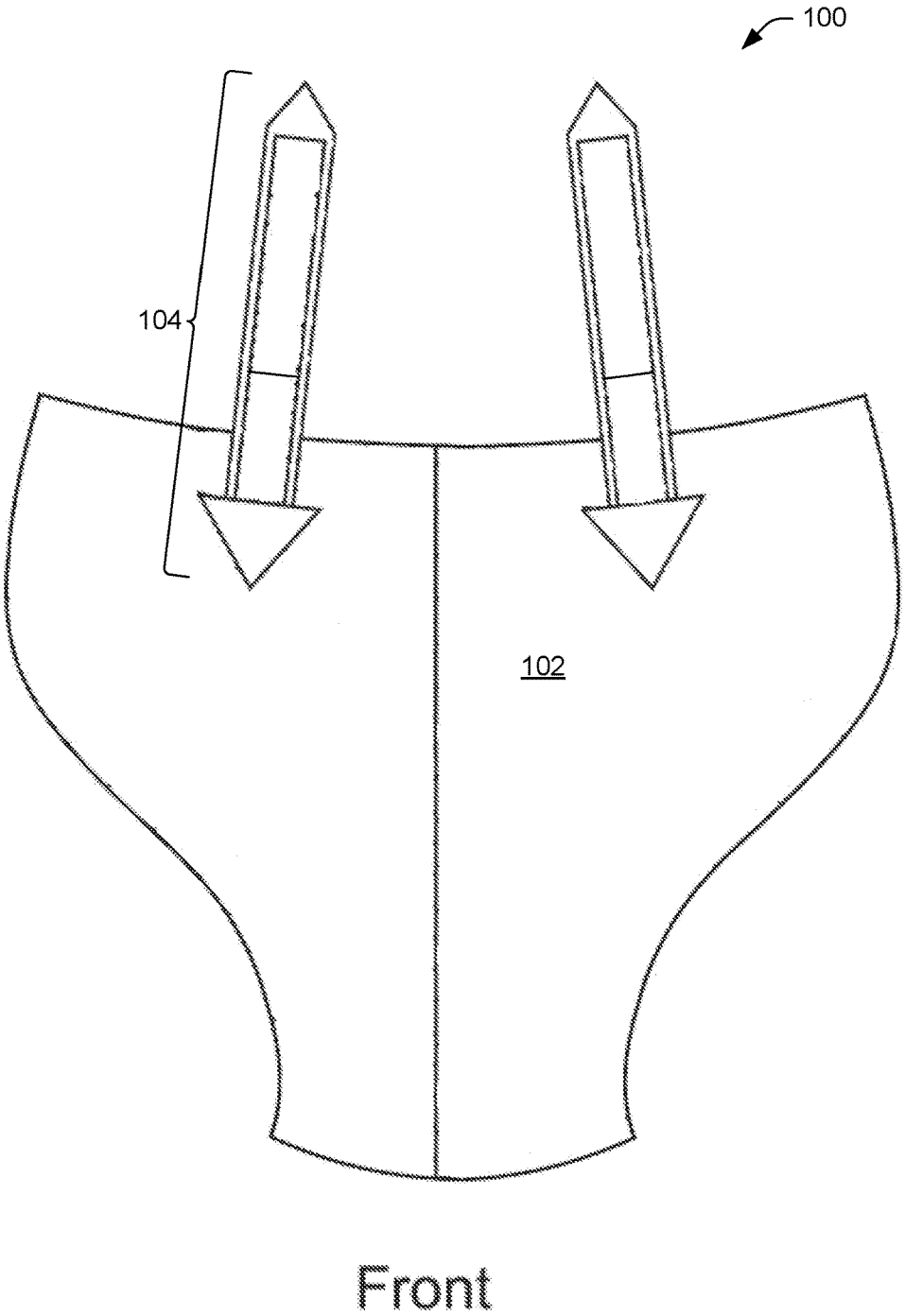
FIG. 1 illustrates a frontal view of a weather exposure reduction apparatus in an assembled embodiment.

FIG. 1 depicts a planar view of the front of the article of apparel 100. The article of apparel 100 may be constructed from a plurality of pieces, which are discussed further herein below. Additionally, and/or alternatively, in an embodiment, the article of apparel 100 may be constructed of a single piece. Moreover, it is contemplated that the article of apparel 100 may be constructed using fewer pieces or more pieces than are described herein. The material used for the article of apparel may be composed of a durable, yet pliable material. For example, in an embodiment, the article of apparel may include bison leather. Generally, potential materials may include one or more of: animal leather, synthetic leather, Gore-Tex® (layers of nylon, PTFE, and polyurethane) or similar polymer based material combination, cotton, wool, vinyl, polyester, etc., or any combination thereof. The article of apparel 100 may be shaped and sized to substantially cover the groin region of a user. Furthermore, in an embodiment, the article of apparel 100 may be sized to substantially fill a space between two leg coverings ("chaps"), or the article of apparel 100 may cover the central groin of a user and yet not fill the space between the two leg coverings.

FIG. 1 further depicts that the article of apparel 100 may include a cover portion 102. As previously mentioned, this cover portion may be constructed of multiple pieces or a single piece. An outer peripheral contour of the cover portion 102 of the article of apparel 100 may be shaped and sized to follow the contour of the legs of a specific user in a riding position. The cover portion 102 is shaped and sized to substantially cover the groin region of the user, allowing the groin region of the user to stay warm and dry, even while the user may be riding in cold and/or wet weather.

The article of apparel 100 may include one or more attachment structures 104. In an embodiment, the one or more attachment structures 104 may include a strap having a hook and loop fastener system. Additionally, and/or alternatively, the attachment structure may include one or more of: a strap, a loop, an adhesive, a hook and loop fastener, a zipper, a button, a snap, a lace, a buckle, a hook-and-eye fastener, etc. The one or more attachment structures 104 are joined to the cover portion 102, to allow a user to be able to attach the article of apparel 100 to a belt of a pair of chaps, a belt of the user, a secondary article of apparel, etc.

The article of apparel 100 may further include a bulge along a center region of the cover portion 102, discussed further herein below. The bulge allows the article of apparel 100 to extend from the waist line of a user to below the groin of the user, while comfortably following a contour of the user in a seated position.

Figure 2:
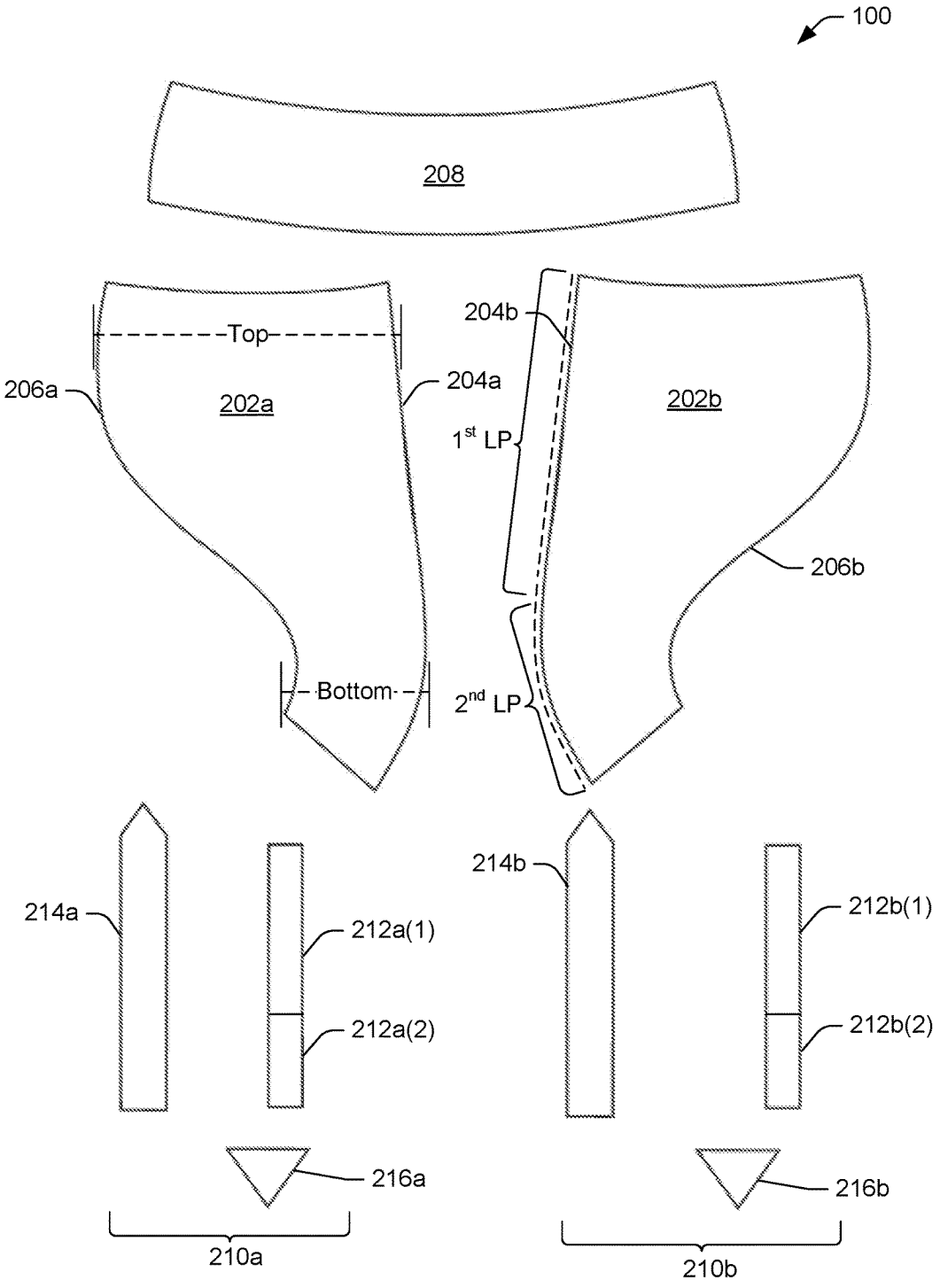
FIG. 2 illustrates a planar view of the weather exposure reduction apparatus of FIG. 1 unassembled.

FIG. 2 depicts a planar view of separated, individual pieces which may be assembled to form the article of apparel in FIG. 1. The article of apparel 100 may include a first cover portion 202*a* and a second cover portion 202*b*. These portions may be joined together to form a cover portion, like cover portion 102 as depicted in FIG. 1. The first cover portion 202*a* has an exterior edge 206*a* and an interior edge 204*a*. The exterior edge 206*a* may have an undulating or wavy shape. The undulating exterior edge 206*a* allows the first cover portion 202*a* to comfortably follow the natural curve of a user's leg as the cover portion hangs against a user's body while in the seated position. The overall width of the body of the first cover portion 202*a* may be substantially tapered, wherein the top of the body ("Top" of the first cover portion 202*a* has a width greater than the bottom of the body ("Bottom"). The interior edge 204*a* of the first cover portion 202*a* may have a substantially linear first length portion ("$1^{st}$ LP") and a second length portion ("$2^{nd}$ LP") that deviates from a direction of extension of the linear first length portion towards the exterior edge 206*a*. The overall length of the first cover portion 202*a* is sized such that the article of apparel 100 may extend from the waistline to below the groin of a user.

The second cover portion 202*b* is a substantially mirrored replication of the first cover portion 202*a*. The second cover portion 202*b* also has an interior edge 204*b* and an exterior edge 206*b* having substantially similar features as the first cover portion 202*a*. Additionally, and/or alternatively, in an embodiment the first cover portion 202*a* and the second cover portion 202*b* may have differences in regard to overall shape or the features of the exterior edges 206*a* and 206*b* and the interior edges 204*a* and 204*b*. Further, in an embodiment, the tapering feature of the first cover portion 202*a* and the second cover portion 202*b* may also have differences. For example, the taper may be more gradual or more severe for one of the portions, or the body may taper to a smaller width or a greater width. This customizability allows for one skilled in the art to size the article of apparel 100 to a particular user.

The interior edges 204*a* and 204*b* may be shaped such that upon bringing the two edges together, the first length portions of each edge, being linear, are substantially parallel to each other. However, the second length portions of each interior edge are shaped to deviate from parallel and extend away from each other. The deviation of the respective second length portions of the first cover portion 202*a* and the second cover portion 202*b* extending away from each other and the parallel interior edges 204*a*, 204*b*, is such that, upon joining the second length portions together, the contortion required of the material going from the linear parallel first length portions to the deviating second length portions creates a bulge or protrusion in the assembled cover portion. That is, when the assembled cover portion is laid down in a neutral position against a flat surface: 1) the top of the body of the cover portion associated with the first length portions may lay substantially in a plane parallel to the flat surface; and 2) the bottom of the body of the cover portion associated with the second length portions may protrude out of the plane parallel to the flat surface and away from the cover portion. This bulge is described further herein below with respect to the description of FIG. 4.

Additionally, and/or alternatively, in another embodiment when a cover portion is formed of a single piece of material, the bulge then may be shaped by water molding, stretching, hardening, manipulating, heating, etc.

Figure 3:
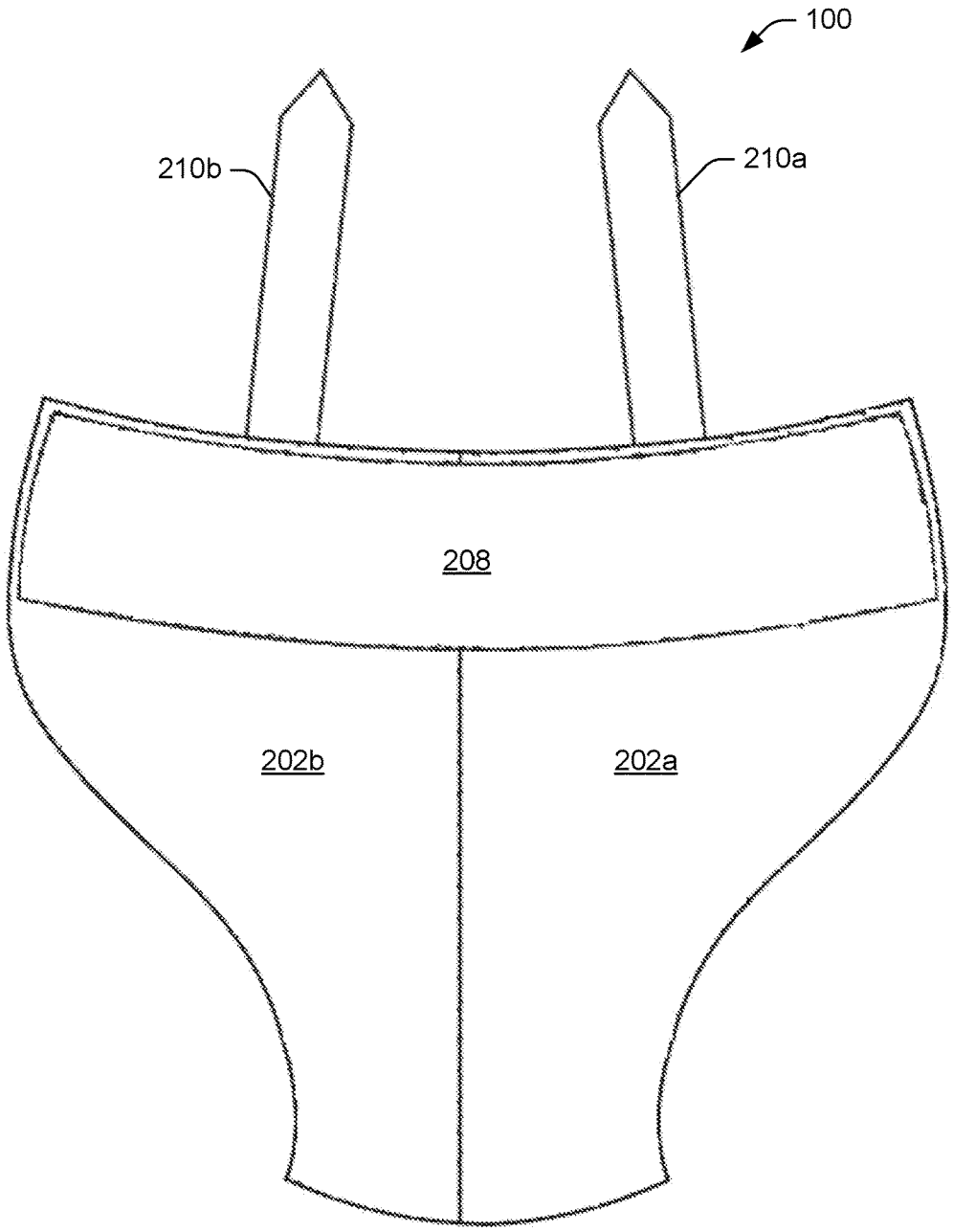
FIG. 3 illustrates a rear view of the assembled weather exposure reduction apparatus of FIG. 1.

The article of apparel 100 may further include a reinforcement strip 208. The reinforcement strip 208 may be disposed on a back side of the article of apparel 100, where the back side is a side facing the waist of a user as seen in FIG. 3, which depicts the placement of the reinforcement strip 208. The reinforcement strip 208 may provide protection to elements (e.g., stitching or other joining aspects, material surfaces, etc.) of the article of apparel 100 from frictional forces against the user's body or clothing, such as a user's belt. In an embodiment, the reinforcement strip 208 may be substantially larger than depicted or smaller, or the reinforcement strip 208 may be omitted entirely. The reinforcement strip 208 may be of a pliable material similar to the rest of the article of apparel 100. In an alternative embodiment, a different pliable material may be used. For example, the reinforcement strip 208 may be one of: bison or other animal leather, synthetic leather, Gore-Tex®, cotton, wool, vinyl, polyester, etc.

The article of apparel 100 may also include one or more attachment structures 210*a*, 210*b*. In an embodiment as depicted in FIG. 2, the attachment structures 210*a* and 210*b* may include strap systems that use a hook and loop fastener. Furthermore, as indicated above, suitable alternative embodiments of the depicted and described attachment structures 210*a*, 210*b* may include one or more of: a strap or string that could be tucked or tied, a loop, an adhesive, a zipper, a button, a snap, a lace, a buckle, a hook-and-eye fastener, etc. The attachment structures 210*a* and 210*b* allow a user to attach the article of apparel 100 to a belt or another secondary article of apparel being worn by the user.

In an embodiment where the attachment structures 210*a* and 210*b* are strap systems as depicted, the attachment structures 210*a* and 212*b* may have multiple pieces including: hook and loop fastening material sections 212*a*(1), 212*b*(1), 212*a*(2), 212*b*(2); a backing 214*a*, 214*b*; and a wear protection tab 216*a*, 216*b*. The pieces of the attachment structures 210*a* and 210*b* may be joined by stitches, adhesive, etc. That is, hook and loop fastening material sections 212*a*(1), 212*b*(1), 212*a*(2), 212*b*(2) may be attached to the respective backings 214*a*, 214*b*. The backings 214*a*, 214*b* are further attached to cover portions 202*a*, 202*b*, respectively, on first ends thereof, and the wear protection tabs 214*a*, 214*b* are attached to either side of respective second ends of the backings 214*a*, 214*b*. Though depicted in FIGS.

1-3 as extending vertically, the attachment structures 210*a* and 210*b* are pliable and may be bent upon themselves in order to form a loop (see FIG. 4) around a chaps belt and thereby engage the hook and loop connection structures to maintain the article of apparel 100 in place until manually disengaged by the user.

With further respect to the pieces, material sections 212*a*(1), 212*b*(1) may be the hook section and material sections 212*a*(2), 212*b*(2) may be the loop section, or vice versa. The backings 214*a*, 214*b* to which the material sections 212*a*(1), 212*b*(1) and 212*a*(2), 212*b*(2) may be joined, respectively, may be formed of a pliable material similar to other materials used for the article of apparel 100. However, as mentioned above, the various pieces of the article of apparel 100, including the backings 214*a*, 214*b* and the wear protection tabs 216*a*, 216*b*, may be made of a different pliable material than that used for the cover portion 102. The wear protection tab 216*a* may be placed as shown in FIG. 1 over the region where the backing 214*a* and the hook and loop material 212*a* are joined to the first and second cover portions 202*a* and 202*b* to thereby protect the stitching or other joining means and reinforce the connection.

While the attachment structures 210*a* and 210*b* are shown as being substantially similar strap systems, in an alternative embodiment, the attachment structures 210*a* and 210*b* may be different. Furthermore, while the attachment structures 210*a* and 210*b* are shown as having substantially rectangular bodies with triangular ends, the various pieces of the attachment structures 210*a* and 210*b* may vary in shape.

As mentioned previously, FIG. 3 depicts a back side of the article of apparel 100. The "back side" refers to the side of the article of apparel 100 that faces the user when attached to the belt of the user or the user's chaps. The back side depicts the previously described reinforcement strip 208. As depicted in FIG. 3, the article of apparel 100 as constructed is sized such that it follows a natural curve of a waist line of a user. The reinforcement strip 208 follows the same curve.

Figure 4:
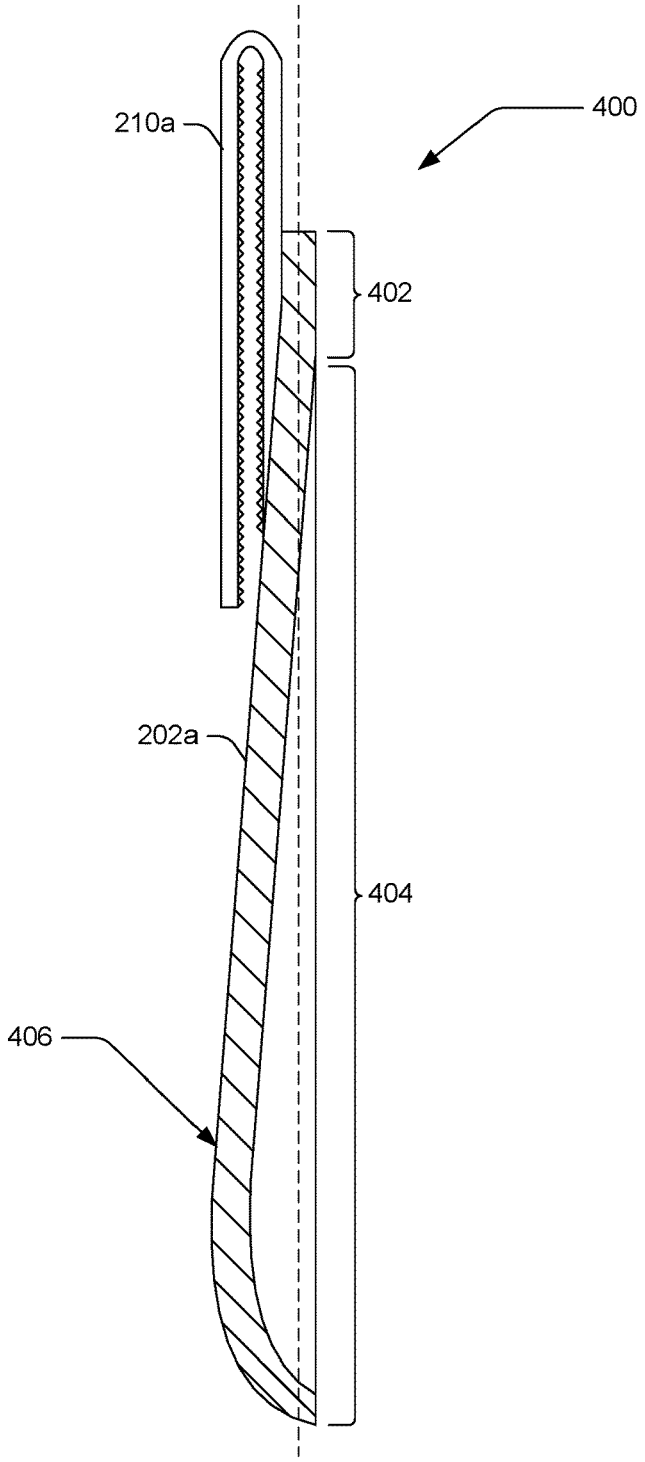
FIG. 4 illustrates a cross-sectional view of the assembled weather exposure reduction apparatus of FIG. 1.

FIG. 4 depicts a cross-sectional view 400 of the article of apparel 100 when laid in a neutral position (not attached to a user's belt), such as on a flat surface, as discussed above. The cover is shaped such that a first portion 402 extends within a plane, which is depicted by the dotted line. The cover also includes a second portion 404 that protrudes out of the plane as a bulge 406 or protrusion. It is noted that, though not capable of being shown in the cross-sectional view of FIG. 4, much of the first cover portion 202*a* and the second cover portion 202*b* lie within the plane, when the article of apparel is laid out in a neutral position. That is, the bulge 406 may only be formed in a portion of the center of the article of apparel 100. The cross-section 400 more easily depicts the bulge 406 as previously described previously in regard to the union of the first cover portion 202*a* and the second cover portion 202*b* (not seen in FIG. 4) to form a single cover. The bulge 406 allows the article of apparel 100 to comfortably and substantially cover the groin region left exposed by the chaps, while the user is in a seated position.

CONCLUSION

Although embodiments have been described in language specific to structural features and/or methodological acts, it is to be understood that the disclosure is not necessarily limited to the specific features or acts described. Rather, the specific features and acts are disclosed herein as illustrative forms of implementing the claimed subject matter.

What is claimed is:

1. An article of apparel comprising:

a covering including a first portion connected to a second portion and a front side and a back side, the back side of the covering including a reinforcement strip disposed thereon; and an attachment structure secured to the covering, the attachment structure configured to join the covering to a secondary article of apparel, wherein a body shape of the first portion of the covering is tapered such that a top width of the first portion is greater than a bottom width of the first portion, the body shape being defined, in part, by an exterior edge and an interior edge, the exterior edge having a wavy profile and a profile of the interior edge having:

a linear first length portion, and a second length portion that deviates away from a direction of extension of the linear first length portion towards the exterior edge, wherein the second portion of the covering is a substantially mirrored replication of the first portion, and wherein the article of apparel further comprises a bulge across a portion of the covering where the respective interior edges of the first portion and the second portion are connected.

2. The article of apparel according to claim 1, wherein the covering, the reinforcement strip, and the attachment structure are composed of a pliable material.

3. The article of apparel according to claim 2, wherein the pliable material includes at least one of: animal leather, synthetic leather, cotton, wool, vinyl, or polyester.

4. The article of apparel according to claim 1, wherein the attachment structure includes at least one strap joined to the covering, a first side of the at least one strap including a pliable material, and a second side of the at least one strap including a hook and loop fastener.

5. The article of apparel according to claim 1, wherein the attachment structure includes at least one of: a strap, a loop, an adhesive, a hook and loop fastener, a zipper, a button, a snap, a lace, a buckle, or a hook-and-eye fastener.

6. The article of apparel according to claim 1, wherein the covering is sized to extend from a waistline to below a groin of a user.

7. An article of apparel, comprising:

a flexible cover having a first portion and a second portion, wherein a body shape of the first portion of the flexible cover is tapered such that a top width of the first portion is greater than a bottom width of the first portion, the body shape being defined, in part, by an exterior edge and an interior edge, the exterior edge having a wavy profile and a profile of the interior edge having:

a linear first length portion, and a second length portion that deviates away from a direction of extension of the linear first length portion towards the exterior edge, wherein the second portion of the covering is a substantially mirrored replication of the first portion, and a structure of the cover defined such that, in a neutral position, the cover includes a first portion that extends within a plane, and a second portion that protrudes out of the plane as a protrusion, a height of the protrusion increasing from the upper section to the lower section, before decreasing to terminate at an end of the lower section; and an attachment structure joined to the covering.

8. The article of apparel according to claim 7, wherein the cover includes at least one of: animal leather, synthetic leather, cotton, wool, vinyl, or polyester.

9. The article of apparel according to claim 8, wherein the cover includes bison leather.

10. The article of apparel according to claim 7, wherein the second portion is formed by stretching, heating, or manipulating a material of the cover.

11. The article of apparel according to claim 7, wherein the cover includes two united pieces of material, each piece of material shaped such that formation of the protrusion of the second portion occurs due to uniting respective inner edges of the two pieces.

12. The article of apparel according to claim 7, wherein the attachment structure includes at least one of: a strap, a loop, an adhesive, a hook and loop fastener, a zipper, a button, a snap, a lace, a buckle, or a hook-and-eye fastener.

13. The article of apparel according to claim 7, wherein the covering includes a reinforcement strip disposed on a back side of the cover to face a user when worn.

14. A protective garment for covering a groin of a user, the protective garment configured to accompany a pair of chaps that cover a portion of legs of the user such that the groin of the user is not covered by the pair of chaps, the protective garment comprising:

a groin covering including a first portion, a second portion, and a bulge that extends across a seam securing the first portion to the second portion, the groin covering shaped and sized to substantially cover a frontal void of material of the pair of chaps between the legs of the user, wherein a body shape of the first portion of the covering is tapered such that a top width of the first portion is greater than a bottom width of the first portion, the body shape being defined, in part, by an exterior edge and an interior edge, the exterior edge having a wavy profile and a profile of the interior edge having:

a linear first length portion, and a second length portion that deviates away from a direction of extension of the linear first length portion towards the exterior edge, wherein the second portion of the covering is a substantially mirrored replication of the first portion; and one or more attachment structures attached to the groin covering.

15. The protective garment according to claim 14, wherein the groin covering includes at least one of: animal leather, synthetic leather, cotton, wool, vinyl, or polyester.

16. The protective garment according to claim 14, wherein the groin covering is sized to extend from a waistline to below the groin of a user.

17. The protective garment according to claim 14, wherein the one or more attachment structures include at least one of: a strap, a loop, an adhesive, a hook and loop fastener, a zipper, a button, a snap, a lace, a buckle, or a hook-and-eye fastener.

18. The protective garment according to claim 14, wherein the one or more attachment structures includes:

a pair of straps attached to the groin covering, the pair of straps spaced apart and extending vertically from the groin covering, each of the pair of straps including a first hook and loop fastener piece on a side thereof facing away from the user, and each strap being pliable and of a length so as to allow the user to form a loop with each strap around a belt of the pair of chaps, and a pair of second hook and loop fastener pieces aligned with the pair of straps respectively and positioned on the groin covering to receive the first hook and loop fastener pieces when the pair of straps are formed in a loop.

19. The protective garment according to claim 14, wherein one or more attachment structures attached to the groin covering such that the one or more attachment structures extend above a top portion of the groin covering, the one or more attachment structures are configured to be attached to the pair of chaps in a substantially vertical orientation.

* * * * *